United States Patent [19]

Cole

[11] Patent Number: 4,787,824

[45] Date of Patent: Nov. 29, 1988

[54] ROTATING LIQUID RING VACUUM PUMP

[75] Inventor: Michael Cole, Ipswich, England

[73] Assignee: Genevac Limited, Ipswich, England

[21] Appl. No.: 87,416

[22] Filed: Aug. 20, 1987

[30] Foreign Application Priority Data

Aug. 23, 1986 [GB] United Kingdom ..... 8620546

[51] Int. Cl.[4] ..... F04C 19/00

[52] U.S. Cl. ..... 417/54; 417/68; 417/76

[58] Field of Search ..... 417/54, 65-69, 417/76, 77

[56] References Cited

U.S. PATENT DOCUMENTS

| | | | |
|---|---|---|---|
| 928,775 | 7/1909 | Mathis | 417/76 X |
| 1,312,707 | 8/1919 | Skidmore, Jr. | 417/66 |
| 1,526,179 | 2/1925 | Parr et al. | 417/174 |
| 1,699,327 | 1/1929 | Durdin, Jr. | 417/67 |
| 1,864,640 | 6/1932 | Dalrymple | 417/68 |
| 1,979,342 | 11/1934 | Parker | 417/65 |
| 2,260,600 | 10/1941 | Boeckeler | 417/77 |
| 2,295,024 | 9/1942 | Boeckeler | 417/77 |
| 3,030,005 | 4/1962 | Nabour et al. | 417/198 X |
| 4,074,954 | 2/1978 | Roberts | 417/68 |
| 4,626,176 | 12/1986 | Cole | 417/68 X |
| 4,634,348 | 1/1987 | Auschrat | 417/68 |

*Primary Examiner*—Paul F. Neils

*Attorney, Agent, or Firm*—Lee & Smith

[57] ABSTRACT

A method of and apparatus for pumping fluids wherein a rotating ring of liquid traverses a hollow probe which has a surface aperture out of which the fluid to be pumped is sucked into the rotating liquid ring, wherein the fluid migrates to a collection region inside the rotating liquid ring, from where the fluid can pass to a fluid outlet, and wherein a gas which does not condense under the prevailing operating conditions is also fed to the collection region in order to assist throughput of the fluid being pumped.

9 Claims, 5 Drawing Sheets

ROTATING LIQUID RING VACUUM PUMP

FIELD OF THE INVENTION

The present invention relates to a pump generally of the type in which a fluid being pumped is drawn out of an aperture in a surface into a liquid due to relative movement between the surface and the liquid. Such a pump will be referred to as a pump of the type described. One example of such a pump is known from EP-A-0165684.

BACKGROUND TO THE INVENTION

In pumps of the type described and in conventional rotary vane pumps, difficulties are encountered in pumping water vapour and vapours of volatile liquids and in pumping solvents (eg acetone).

With conventional pumps the difficulty with vapours arises because the substance being pumped tends to condense as it is pumped, so that output from the pump substantially decreases or ceases altogether. In theory, this problem could be overcome by running the pump at high temperatures, so that the vapour does not condense, but in conventional rotary vane pumps it has proved difficult to maintain correct clearances between relatively moving parts over extremes of temperature ranging from room temperature to 100° C. or more.

In the case of solvents, a further problem is that they tend to dissolve in the oil normally used as the pumping liquid. It is known to use air to strip dissolved solvent out of the oil but the apparatus is cumbersome and the pumping rate is slow.

In a pump of the type described the fluid being pumped will normally be less dense than the rotating liquid ring, and having passed from the aperture into the ring will move rapidly to the centre of the rotating liquid. Thus the fluid accumulates in the central region of the pump from where it flows through a discharge passage which communicates with the central region of the pump.

Because this type of pump can be made without the need for very close tolerances in clearances in the main pumping chamber, the pump can be run at relatively high temperatures typically in the range 120° C. to 160° C., so that volatile fluids including water vapour do not tend to condense in the high pressure central region. Even so, it has been found in practice that when such fluids are being pumped there tends to be a significant reduction or cessation in output from the pump. It is believed that the problem may result from condensation of the vapour on cooler parts in the discharge line, with condensed droplets subsequently falling back into the main pumping chamber since the discharge line tends to lead vertically upwards. Although such droplets will boil off again, they can interfere with the pump operation in the meantime.

This type of pump also suffers from the problem that solvents tend to dissolve in the rotating liquid ring. Ideally a liquid is chosen in which the solvent will not dissolve, but it is not always possible to select such an alternative liquid since the choice of liquid is dictated by other considerations also particularly it must have a low vapour pressure at the temperatures of operation in order not to interfere with the operation of the pump and this tends to dictate the use of oils in which most solvents are to a greater or lesser extent, soluble. As the partial pressure of the dissolved solvent in the rotating liquid ring builds up, it begins to inhibit the movement of further solvent out through the aperture into the liquid, and in practice it is impossible to apply to a solvent a suction pressure below the partial pressure of the solvent which has built up in the rotating liquid ring.

SUMMARY OF THE INVENTION

According to a first aspect of the present invention there is provided a method of pumping fluids in which the fluid being pumped is drawn out of an aperture in a surface into a liquid passing thereover, by the reduction in pressure at the surface caused by the relative movement between the liquid and the surface to pass through the liquid to a collection region from which it can pass as an outflow, in which method a gas which does not condense at the operating temperatures and pressures of the pump is also delivered to the collection region in addition to the fluid.

The gas may be supplied directly to the collection region through an inlet, although in this case it may be necessary to drive the gas as by a fan or compressor in order to ensure flow in the correct direction.

Alternatively, the gas may be supplied to a further aperture in the aforementioned, or another, surface over which the liquid passes, the passage of liquid serving to draw the gas out of the further aperture after which it migrates through the liquid to the collection region.

According to a second aspect of the invention, there is provided a pump having a surface with an aperture therein, means to deliver a fluid to be pumped to the aperture, means to effect relative motion between the surface and a liquid so as to draw fluid out of the aperture by virtue of the reduction in pressure in the liquid caused by the relative movement, means to discharge the fluid from a collection region to which it tends to migrate after being drawn through the aperture, and means to supply to the collection region a gas, in addition to the fluid being pumped.

The gas supply means may comprise a nozzle for delivering gas directly to the collection region. Alternatively, the pump may have a further aperture in the aforementioned, or another, surface over which the liquid passes, and means to supply gas to the further aperture, the passage of the liquid thereover serving to draw the gas out of the aperture into the liquid, to migrate to the collection region in the same manner as the fluid.

Normally, the liquid will rotate in a ring and the apertured surface or surfaces will be stationary, with the collection region for the pumped fluid being central of the rotating liquid ring.

When the pumped fluid is soluble in the liquid, such as solvent, the provision of a gas in this manner assists in carrying the soluble fluid away and maintaining the partial pressure of the soluble fluid in the liquid at a relatively low level. It is particularly preferable to employ a further aperture as the means for introducing the gas so that the gas migrates through the rotating liquid, as this is found to be more effective in stripping the fluid out of the liquid, than providing the gas directly to the collection region.

Thus a solution is provided to the problem of pumping fluids which dissolve in the liquid, which is simpler and more effective than the arrangements employed in the prior art.

Surprisingly, it has also been found that where the fluid to be pumped is a vapour, the provision of a gas to the collection region enables vapours to be pumped which otherwise failed to provide an output flow. Accordingly, the present invention enables steam to be pumped effectively, which hitherto has only been achieved with difficulty.

The precise mechanism whereby the introduction of a gas produces these desirable effects is not entirely understood. However, it is believed that since the gas does not condense in the collection region, it establishes a flow through the outlet of the pump which due to entrainment or simple mixing or otherwise, causes the fluid also to be carried through the outlet of the pump.

In a preferred construction, a stationary probe is provided in a rotating ring of liquid, and both the aperture for the fluid to be pumped and the further aperture for the gas are provided in the external surface of the probe. Advantageously the aperture for the fluid is provided in a radially outwardly facing surface of the probe and the aperture for the gas is provided in a radially inwardly facing surface of the probe, the latter being completely immersed in the liquid in use, so that the liquid traverses both apertures. Since the gas and the fluid will tend to migrate to the centre of the liquid ring, the path of the gas bubbles from the gas aperture will not normally encounter the fluid aperture. This reduces any problems which could be caused by gas bubbles tending to enter the aperture through which the fluid should be exiting, thereby disrupting the pumping operation.

Preferably, the probe is generally hydrofoil shaped, having a leading edge, a trailing edge, a radially inner external surface and a relatively longer radially outer external surface, extending between the two edges. With a probe of this shape, the angle of attack of the probe on the rotating liquid ring may be selected so as to provide a region of low pressure in the liquid adjacent to the radially inner surface of the probe in the vicinity of the leading edge. The aperture for the gas may be provided in the radially inner surface at this point, so that the low liquid pressure in this region will tend to draw out the gas. The precise cause of this low pressure region in the liquid is not fully understood but it is believed that it may be due to a bow shock in the liquid at the leading edge of the probe.

The gas used should be selected in accordance with the operating temperature and pressure of the pump, the particular liquid used in the pump and the fluid to be pumped. However, in many cases air is acceptable.

Arrangements in which the moving liquid draws the gas into the pump through a further aperture are especially advantageous where the gas is air and the pressure at the collection region is atmospheric or greater since air is thus delivered to the collection region without the need for a further pump specifically for the air.

If the air was to be provided directly to the collection region for example through an inlet nozzle, some form of pump, fan or compressor means would be necessary to ensure the flow of air into the collection region.

The amount of gas provided to the collection region is typically between 1% and 20% of the volume flow rate at the inlet to the pump. Pumps of the type disclosed in EP-A-0165684 can provide very large pressure differentials between inlet and outlet, and a pump delivering to atmospheric pressure can typically create an inlet pressure of 1/1000 of an atmosphere. Under these circumstances, compression of the fluid being pumped as it passes through the pump will eventually mean that a very large proportion of the output volume is the gas. It is possible to create conditions in which more than 90%, possibly even more than 99% of the output volume may be gas. Thus if the pump is used to evacuate a vessel originally at atmospheric pressure, the gas will initially comprise only a small proportion of the outlet volume but as the vessel becomes evacuated down toward the maximum level achievable by the pump, the gas will comprise a greater and greater percentage of the output volume until at the maximum level of evacuation possible by the pump, the output will be wholly comprised by the gas.

As mentioned above, the liquid used in the pump preferably has a low vapour pressure at the working temperature of the pump. For this reason, it is presently preferred to use long chain hydrocarbons or fluorinated hydrocarbons typically having an average molecular weight in the region of 500.

Preferably a disc, which may also support the probe, extends radially of the outlet or a member containing the outlet to be peripherally immersed in the liquid ring during operation of the pump. In this manner, a seal can be provided to prevent the fluid being pumped from passing between the collection region and the stationary parts of the pump housing through which an outlet passage extends to convey the collected fluid out of the rotating drum or other means containing the liquid. Accordingly, it is possible to avoid the need for sealing rings and also to prevent the fluid being pumped from coming into contact with any bearings or relatively moving surfaces. Accordingly, there is a wide choice of materials available for all parts of the pump which will come into contact with the fluid being pumped, and this facilitates the choice of material which will not be subject to chemical attack from the fluid. Thus, where steam is to be pumped all such parts may be made, for example, from stainless steel, aluminium or a suitable polymer.

Embodiments of the present invention, given by way of non-limitative example, will now be described with reference to the accompanying drawings, in which.

DETAILED DESCRIPTION OF THE DRAWINGS

The illustrated embodiments of the present invention are variations of the type of pump disclosed in EP-A-0165684. Accordingly, before the embodiments are discussed the general principles of operation of such a pump will be explained with references to FIG. 1.

Figure 1:
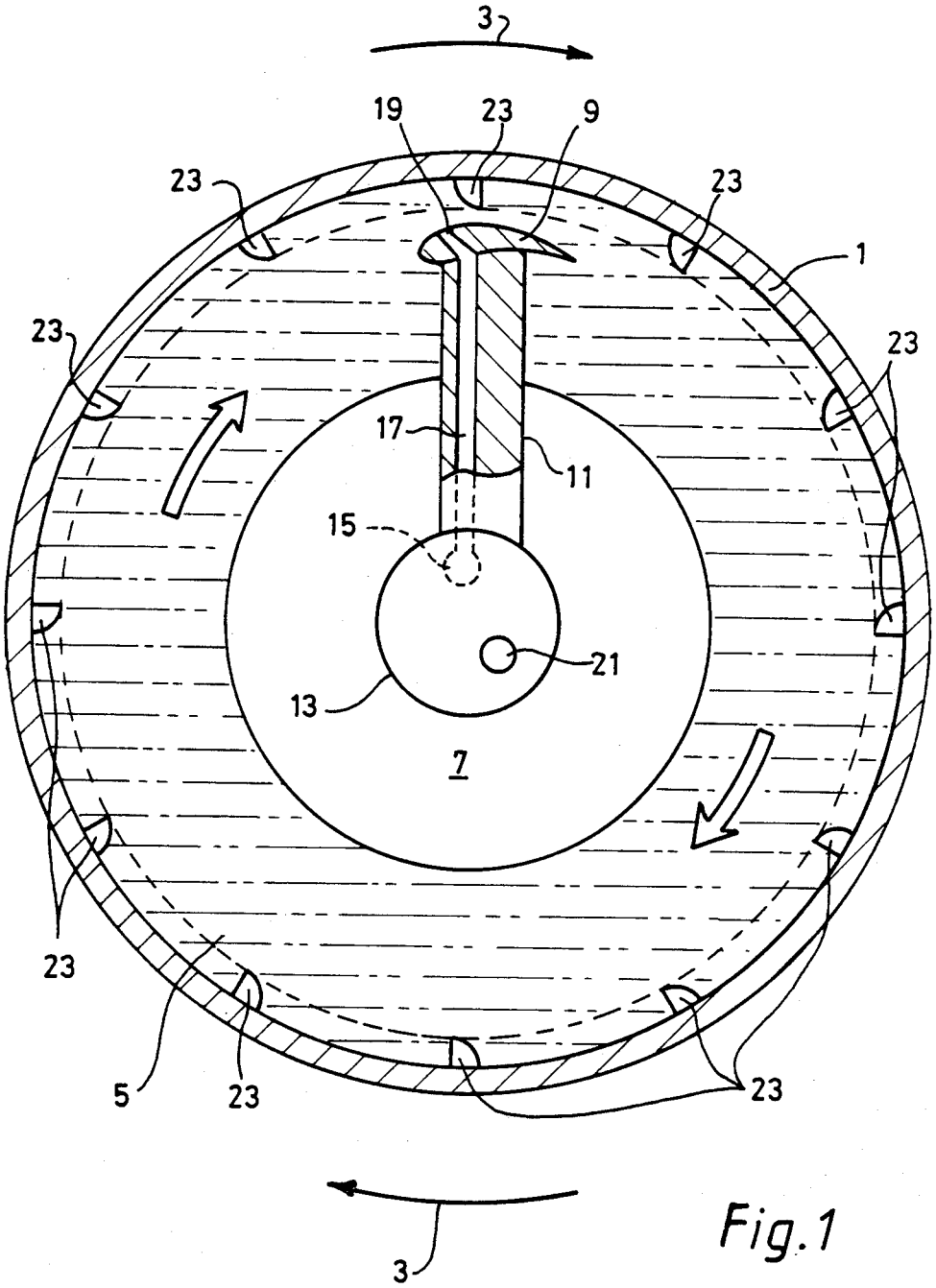
FIG. 1 is a schematic radial section through the rotating drum and stationary probe of a pump of the type disclosed in EP-A-0165684.
Figure 2:
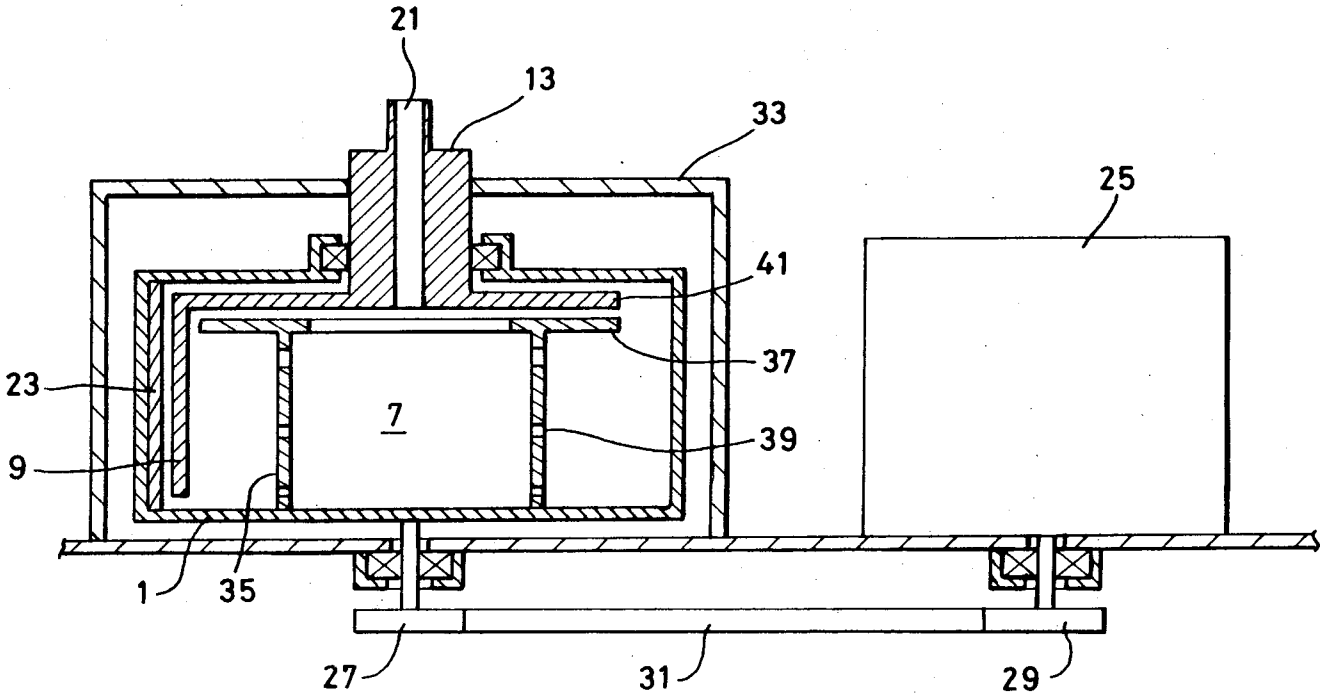
FIG. 2 is a schematic axial section showing one possible layout of the major components in a pump of the type disclosed in EP-A-0165684 which may be modified in accordance the present invention.

FIG. 1 is based on FIG. 2 of EP-A-0165684, and shows schematically one arrangement of components whereby a pumping action can be obtained by the passage of liquid over an aperture in an external probe surface, to draw a fluid out through the aperture by virtue of the reduced pressure created at the surface because of the movement of the liquid relative thereto.

A drum 1 rotates in the direction of arrows 3, causing a body of liquid 5 contained in the drum 1 to rotate in a similar manner. The centrifugal effect of the rotation on the liquid 5 causes it to form a ring, as shown, around the circumference of the drum 1, leaving a liquid-free region 7 around the drum axis.

A stationary probe, in the form of a wing 9, is held in place in the rotating ring of liquid 5 by a support arm 11. The support arm 11 extends from a central axial core 13 which extends from outside the drum 1 through one end thereof.

An inlet passage 15 within the core 13 communicates with a passage 17 in the support arm 11, which in turn communicates with an aperture 19 in the radially outer surface of the probe wing 9. An outlet passage 21 extends along the core 13 to its end face, and is in communication with the central region 7.

In operation, small protrusions 23 spaced around the inner circumference of the drum 1 tend to maintain the rotation of the ring of liquid 5, and since the clearance between the radially outer surface of the probe wing 9 and the protrusions 23 is small, they tend to cause accelerations in the flow of liquid over the outer surface of the wing 9. The relative movement between the liquid 5 and the wing 9 results in a reduction in the pressure in the region of the external surface of the wing 9. This pressure reduction causes fluid in the passage 17 to flow out through the aperture 19 into the liquid 5. The liquid 5 is chosen to be denser than the fluid to be pumped, and therefore the bubbles of fluid in the liquid 5 which have been drawn out of aperture 19 pass rapidly to the central area 7. Thus the central area 7 becomes filled with fluid, which can leave the drum along the discharge passage 21.

Various different arrangements of parts are possible, and FIG. 1 is intended only to provide a general understanding of the principal of operation of a pump of this type. For further details and alternatives reference should be made to EP-A-0165684.

FIG. 2 shows the arrangement of the major components of a pump constructed to operate along the principles described above.

A particular feature of the arrangement shown in FIG. 2 is that the axis of the drum 1 is vertical and the central core 13 extends through the upper end of the drum. The lower end of the drum 1 is closed, and liquid will collect in this end when the drum is stationary, but will form an annulus within the drum when the latter rotates. In this orientation there will be no tendency for the liquid to approach the central upper region of the wall of the drum 1 through which the core 13 passes.

Additionally, the arm 11 is replaced by a disc 41 extending radially from the end of the core member 13 so that its periphery is wholly immersed in the liquid 5 during rotation. This provides a seal between the fluid collected in the central region 7 and the upper end of the drum 1, so that during operation of the pump the fluid will not come into contact with this upper region of the drum.

Accordingly, the bearing between the drum 1 and the core 13 is not subjected to either the liquid 5 or the fluid being pumped and can be constructed from any convenient material. Conversely, all parts which do come into contact with the liquid, or the fluid to be pumped, must be made of a material capable of withstanding those substances but there is no requirement for the materials chosen for these other parts (which come into contact with the liquid or fluid) to be capable of providing bearing surfaces. Thus pumps can be designed specifically to pump with vapour, solvents or acids by a suitable choice of materials.

In FIG. 2, the drum 1 is driven in rotation by a motor 25 by means of toothed wheels 27, 29 and a toothed belt 31. The drum 1 is enclosed in a stationary housing 33. The central core 13 extends through the upper end wall of the drum 1 and through the top of the housing 23 as mentioned above.

The drum 1 contains an inner cylinder 35 which is mounted on the lower end wall of the drum 1 and rotates with it. The upper end of the cylinder 35 includes a radial flange 37 which is closely spaced from the lower end face of the core 13.

The wall of the inner cylinder 35 has apertures 39 through which fluid, drawn out of the aperture in the wing 9 into the rotating ring of liquid 5, can pass into the central space 7 within the cylinder 35. The upper end of the cylinder 35 is open, so that fluid collected in the central space 7 can pass upwardly into and through the fluid outlet passage 21.

As mentioned above in the FIG. 2 embodiment, the arm 11 of FIG. 1 is replaced by radial flange 41 at the lower end of the central core 13. This flange forms, with the lower end face of the core 13, which is axially very close to the flange 37 of the cylinder 35. In use, the disc 41 remains stationary and sufficient liquid is contained in the drum 1 for the radially outermost portions of the disc 41 and flange 37 to be immersed in the ring of liquid and for a thin liquid film to be formed therebetween.

The wing 9 extends over the greater part of the axial length of the drum 1 and is positioned radially so as to occupy the space between the outer edge of the flange 37 and the path of the radially innermost parts of the protrusions 23.

For reasons of clarity, the inlet passage for the fluid being pumped, which passes axially through the central core 13 and radially through the disc 41 to the wing 9, is not shown in FIG. 2.

The illustrated pump may be made to various sizes. A convenient size of pump has the following dimensions:

- a drum 1 diameter of 15 to 20 cm;
- a wing 9 length of about 7 cm, with the fluid outlet aperture 19 being slot-shaped and extending over substantially the whole of the wing length;
- and a distance from the pump axis to the radially outer surface of the wing of about 7 cm.

If the drum of such a pump is driven at 3,000 rpm a volume flow rate at the input of 50 liters per min can be achieved, and if the pump outlet delivers to atmosphere, an inlet pressure of 0.001 atmospheres can be obtained.

If the pump is made of appropriate materials, and the liquid 5 is chosen appropriately, it is possible to run a pump of the type illustrated in FIGS. 1 and 2 at 120° C. to 160° C. At this temperature, water vapour is capable of being pumped without condensing. However, the pump as shown still has difficulty in pumping water vapour. The reason for this is not completely clear but appears to be due to the vapour condensing in the cooler fluid outlet passage 21, and dripping back into the pump due to the fact that the fluid outlet passage 21 is maintained at a temperature below the pump operating temperature, so as to reduce the thermal stress on the bearing between the upper end face of the drum 1 and the central core 13.

As also previously mentioned a further difficulty arises with some fluids to be pumped, typically solvents such as acetone, which tend to dissolve in the liquid 5 after passing out through the aperture 19 in the wing 9. As the vapour pressure of the dissolved fluid in the liquid 5 increases, this begins to inhibit further fluid from passing out through the aperture 19.

In both cases, satisfactory operation of the pump can be restored by providing a gas flow (normally air) to the central space 7. How this works when pumping water vapour is not fully understood. In the case of fluids which dissolve in the liquid 5, it is believed that the passage of gas through the pump tends to promote evaporation of dissolved fluid from the liquid 5, so reducing the vapour pressure of the fluid within the liquid 5.

Typically, the rate of supply of gas is 1% to 10% of the pump inlet flow rate. Thus for the pump referred to above, with an inlet flow rate of 50 liters per minute, gas would be supplied at 0.5 to 10 liters per minute.

Figure 3:
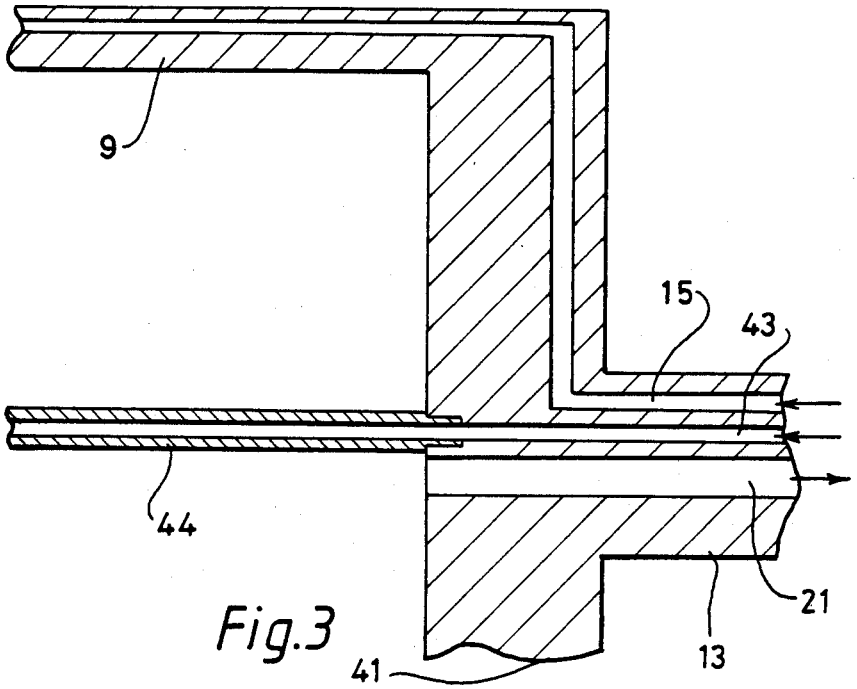
FIG. 3 shows the arrangement of fluid and gas inlet and outlet passages in a first embodiment of the present invention.

FIG. 3 shows an arrangement of fluid inlet and outlet passages which enable such a gas flow to the central space 7 to be effected.

In FIG. 3 there is shown a part of the central core 13, a disc 41 and wing 9 of the stationary part of the pump. A fluid inlet passage 15 in the core 13 (for the fluid to be pumped) runs radially outwardly within the thickness of the disc 41 and then within the thickness of the wing 9, to an aperture (similar to the aperture 19 of FIG. 1), through which the fluid will pass into the liquid 5. The aperture 19 is normally elongate and extends over substantially the whole length of the wing 9. An outlet passage 21 in the central core 13 communicates with the central region 7. In addition, a gas inlet passage 43 is provided in the core 13 parallel to the fluid outlet passage 21. Gas is supplied through the line 43 to the central region 7 in order to flush the latter if and when required.

In order to ensure a good mixing of the gas with the fluid collected in the space 7, a pipe 44 extends from the end of the central core 13 into the space 7, to carry the gas down to the end of the region 7 remote from the mouth of the outlet passage 21.

In FIG. 3, the pressure of the gas supplied to the line 43 must be greater than the pressure prevailing in the central region 7 in use, in order to ensure that the gas flows correctly along the line into the central region 7. If the pump is to be used to raise a fluid to atmospheric pressure or above and the gas is to be air, it will normally be desirable to provide a fan or compressor to deliver the air to the passage 43 (though a supply of ready-compressed air can be used if available). Such an air fan or compressor can conveniently be driven from the shaft of the drum 1 or by a further take-off from the motor 25.

Figure 4:
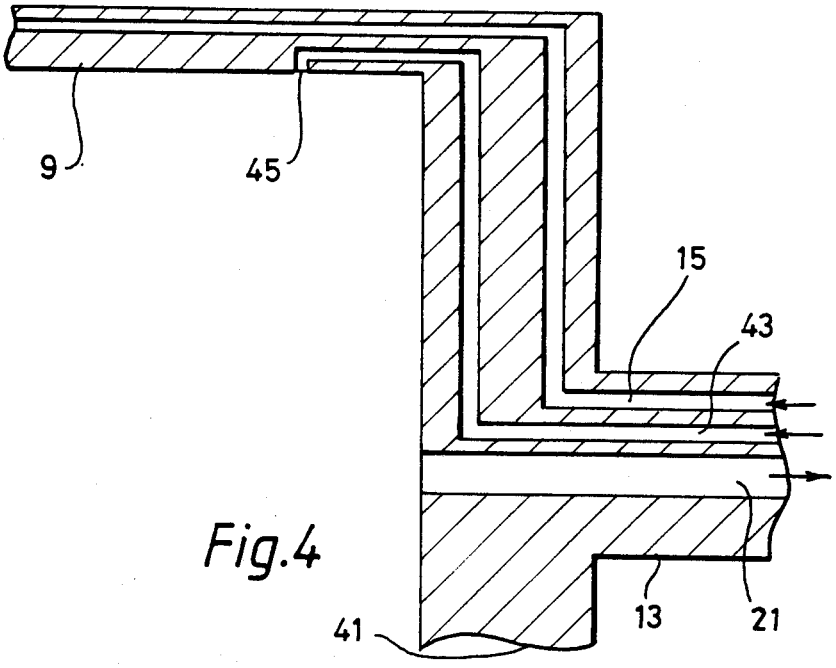
FIG. 4 shows the arrangement of fluid and gas inlet and outlet passages in a second embodiment of the present invention.

FIG. 4 shows an alternative to the arrangement of FIG. 3 in which the gas supply passage 43 passes radially outwardly through the disc 41 and then into the wing 9. The gas supply passage 43 communicates with a small aperture 45 in the radially inner surface of the wing. It is arranged such that the liquid 5 passing over the aperture 45 tends to draw the gas out through the aperture and in this way if the line 43 is connected to air at atmospheric pressure, the air will still tend to flow into the pump even though the central space 7 may be at a pressure above atmospheric and in that event a fan or compressor for the air, referred to in relation to the arrangement of FIG. 3, is not required.

This arrangement is particularly preferred when the fluid being pumped tends to dissolve in the liquid 5. The intimate mixing of the gas with the liquid 5 as it bubbles to the central region 7 increases the evaporative effect on the dissolved fluid.

When the arrangement of FIG. 4 is being used, it is preferable that the aperture 19 is in the radially outer surface of the wing 9 while the aperture 45 for the gas is on the inner surface, so that as the bubbles of the gas travel from the aperture 45 to the central region 7 they are less likely to encounter the fluid aperture 19. This avoids any undesirable effects which might otherwise result such as loss of pump suction effect on the fluid inlet line 15 or even entry of the gas into the fluid inlet line through the aperture 19.

In FIGS. 3 and 4 the components are shown in exaggerated thickness, and in FIG. 4 the gas and fluid inlet passages are shown spaced in the axial direction of the disc 41 whereas normally the disc would be thinner and the two passages would be spaced in the circumferential direction of the disc.

Figure 5:
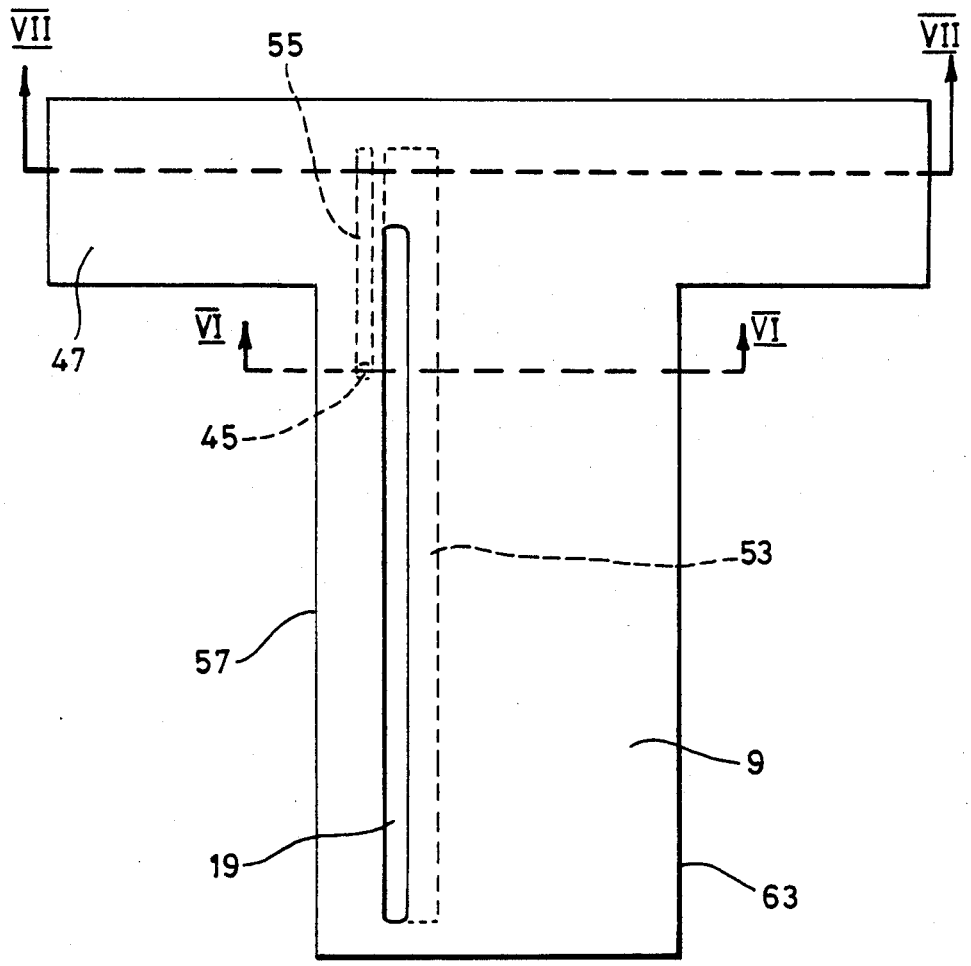
FIG. 5 is a view from above (as in FIG. 4) of the probe wing and support in a pump having an arrangement of inlet passages such as shown in FIG. 4.
Figure 6:
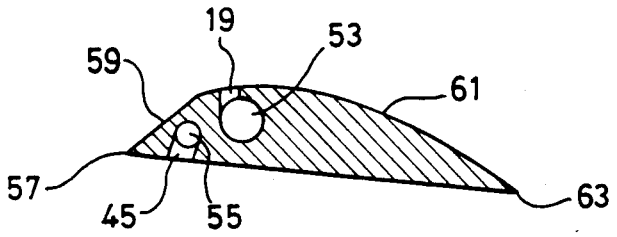
FIG. 6 is a section of the probe wing of FIG. 5 along line VI—VI.
Figure 7:
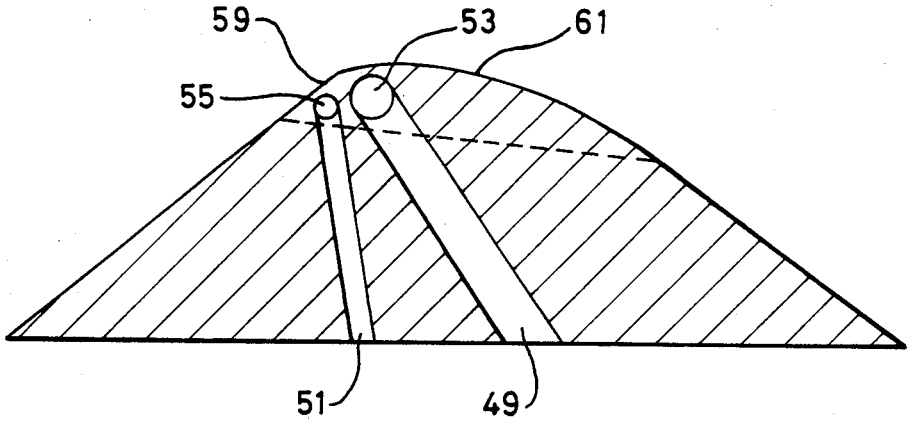
FIG. 7 is a section through the probe wing support of FIG. 5 along line VII—VII.

FIGS. 5, 6 and 7 show an element which forms a wing and a wing support in a preferred embodiment of the present invention which functions according to the principles described with reference to FIG. 4.

FIG. 5 is a view of the radially outwardly facing surface of the element. It has a wing 9 which extends from a support 47. The pump in which the element is used has the general structure illustrated in FIG. 2, and, when assembled in the pump, the support 47 is mounted on the support disc 41, with the fluid and gas inlet passages in the disc 41 in communication with respective bores in the support 47.

The radially outer edge of the support 47 is curved in the same way as is the radially outwardly facing surface of the wing 9. The line of the radially inwardly facing surface of the wing 9 is shown as a broken line in FIG. 7.

As is best seen in FIG. 7, the support 47 has two passages 49 and 51 which extend in a common radial plane but at respective angles to radii of the drum 1 and disc 41. The wider passage 49 is for the fluid to be pumped and the narrower passage 51 is for the gas. At their upper ends, these passages 49, 51 communicate with a fluid bore 53 and a gas passage 55, respectively, in the wing 9. The extent of the passages 53, 55 in the wing 9 can be seen from FIG. 5 where they are shown in broken outline.

A long slit-like aperture 19 extends over substantially the whole length of the wing 9 in its radially outwardly facing surface, and is in communication with the fluid passage 53. The aperture 19 is relatively close to the leading edge 57 of the wing, i.e. that edge which is encountered first by the rotating ring of liquid 5 in the drum 1. As can be seen in FIGS. 6 and 7, the aperture 19 is positioned just behind the junction between a substantially planar leading surface region 59 and the downstream remainder 61 of the radially outwardly facing surface of the wing 9.

This configuration of the radially outwardly facing surface of the wing 9 and this position for the aperture 19 creates a high velocity stream of liquid over the aperture 19 and accordingly ensures that the fluid therein experiences a significant suction effect and is thus efficiently drawn out of the aperture 19.

As can be seen in FIG. 5, the passage 55 in the wing 9 which supplies the gas is relatively short, and communicates with a short elongate aperture 45. As is best seen in FIG. 7, the leading edge 57 of the wing is radially further from the pump axis than the trailing edge 63 of the wing. At this particular angle of attack on the rotating ring of liquid 5, a low pressure region forms in the liquid adjacent the radially inwardly facing surface of the wing 9 immediately downstream of the leading edge 57, and the gas aperture 45 is arranged to open into this low pressure region. This assists in drawing the gas out through the aperture 45.

It has been found that a pump having the general structure shown in FIG. 2 and employing a wing as shown in FIGS. 5, 6 and 7 will pump water vapour and solvents effectively at temperatures in the region of 120° C. to 160° C.

As will be readily apparent to those skilled in the art, various modifications to the structures illustrated in the drawings are possible within the scope of the present invention.

I claim:

1. A pump for pumping a fluid, comprising means for producing a rotating ring of a liquid whose density is greater than that of said fluid, a stationary probe having external surfaces immersed in the liquid and facing radially outward and inward respectively relative to said rotating ring of liquid, an outward aperture formed in said outward surface, the shape of said outward surface being such that fluid is drawn out of said outward aperture by virtue of the reduction in pressure in the liquid caused by rotation of said ring of liquid over said outward surface, means to deliver fluid to be pumped to said outward aperture, a collection region for the fluid to which the fluid migrates after being drawn out of said outward aperture, means to discharge fluid from said collection region, an inward aperture formed in said inward surface, a gas supply passage extending to said inward aperture, and supply means to supply a gas to said inner aperture and into the liquid.

2. A pump according to claim 1, wherein said probe is generally hydrofoil shaped, having a leading edge, a trailing edge, a radially inner external surface and a relatively longer radially outer external surface, extending between the two edges, the angle of attack of the probe on the rotating liquid ring being selected to provide a region of low pressure in the liquid adjacent the radially inner surface of the probe in the vicinity of its leading edge, the aperture for gas being provided in the radially inner surface in this region.

3. A pump according to claim 1, including a probe-supporting disc which extends radially relatively to said discharge means so as to be peripherally immersed in said liquid ring and provide a seal, whereby unwanted leakage of the fluid being pumped from said collection region is prevented.

4. A pump for pumping fluid, comprising means for producing a rotating ring of a liquid whose density is greater than that of the fluid, a stationary member having an external surface immersed in the liquid and having an aperture formed in said surface, means to deliver fluid to be pumped to said aperture, the shape of said surface being such that fluid is drawn out of said aperture by virtue of the reduction in pressure in the liquid caused by rotation of said ring of liquid over said surface, a collection region for the fluid to which the fluid migrates after being drawn out of said aperture, means to discharge the fluid from said collection region, and supply means to supply a gas to the pump so that it flows into said collection region in addition to the fluid being pumped, said gas being of a type which does not condense at the operating temperatures and pressures of the pump.

5. A pump according to claim 4, in which said supply means supplies the gas directly to the collection region, and including a forcing means for assisting delivery of gas to the collection region.

6. A method of pumping a fluid such as a water vapor, comprising the steps of:

(a) causing a ring of a liquid having a greater density than that of the fluid to pass over an external surface having an aperture therein, the surface being so shaped that fluid is drawn out of the aperture by virtue of the reduction in pressure in the liquid caused by the passage of the ring of liquid over the surface;

(b) collecting the fluid at a collection region free of the liquid, after its migration through the liquid; and (c) supplying a gas so that said gas flows into the collection region in addition to the fluid being pumped, said gas being of a type which does not condense at the temperature and pressure of the pumping operation.

7. A method according to claim 6, according to which the gas is directly supplied to the collection region.

8. A method according to claim 6, according to which the gas is supplied to a further aperture in the aforementioned, or another, surface over which the liquid passes, the passage of liquid serving to draw the gas out of the further aperture after which it migrates through the liquid to the collection region.

9. A method according to claim 6, in which the amount of gas provided in the collection region is between 1 percent and 20 percent of the volume flow rate at the inlet to the pump.

* * * * *